United States Patent [19]

Shiraiwa et al.

[11] Patent Number: 4,514,721

[45] Date of Patent: Apr. 30, 1985

[54] MULTI-OPERATION MODE TYPE OF SECURITY-ENSURING APPARATUS

[75] Inventors: Toshiyuki Shiraiwa, Ichikawa; Kaoru Ooba, Higashimurayama, both of Japan

[73] Assignee: Secom Co., Ltd., Tokyo, Japan

[21] Appl. No.: 509,148

[22] Filed: Jun. 29, 1983

[30] Foreign Application Priority Data

Jun. 30, 1982 [JP] Japan ..... 57-111444

[51] Int. Cl.[3] ..... G08B 23/00

[52] U.S. Cl. ..... 340/527; 340/506; 340/500; 340/531

[58] Field of Search ..... 340/527, 529, 531, 532–534, 340/539, 500, 506, 517, 521, 524, 525, 825.06, 825.1, 825.11, 825.12, 825.36

[56] References Cited

U.S. PATENT DOCUMENTS 3,678,391 7/1972 Gough ..... 455/38
3,914,692 10/1975 Seaborn, Jr. ..... 340/539
3,925,763 12/1975 Wadhwani et al. ..... 340/538

*Primary Examiner*—Donnie L. Crosland
*Attorney, Agent, or Firm*—Armstrong, Nikaido, Marmelstein & Kubovcik

[57] ABSTRACT

A security-ensuring apparatus capable of operating in an unmanned security-ensuring operation mode, a manned security-ensuring operation mode, or a management operation mode having at least a maintenance mode or a patrol mode, the apparatus having an operation mode-switching unit, an emergency-detecting unit for detecting an emergency or abnormality which has occurred in a predetermined area, and a control unit for permitting transmission of an emergency or abnormality signal to a central monitoring station on the basis of discrimination of the current operation mode of the apparatus.

10 Claims, 7 Drawing Figures

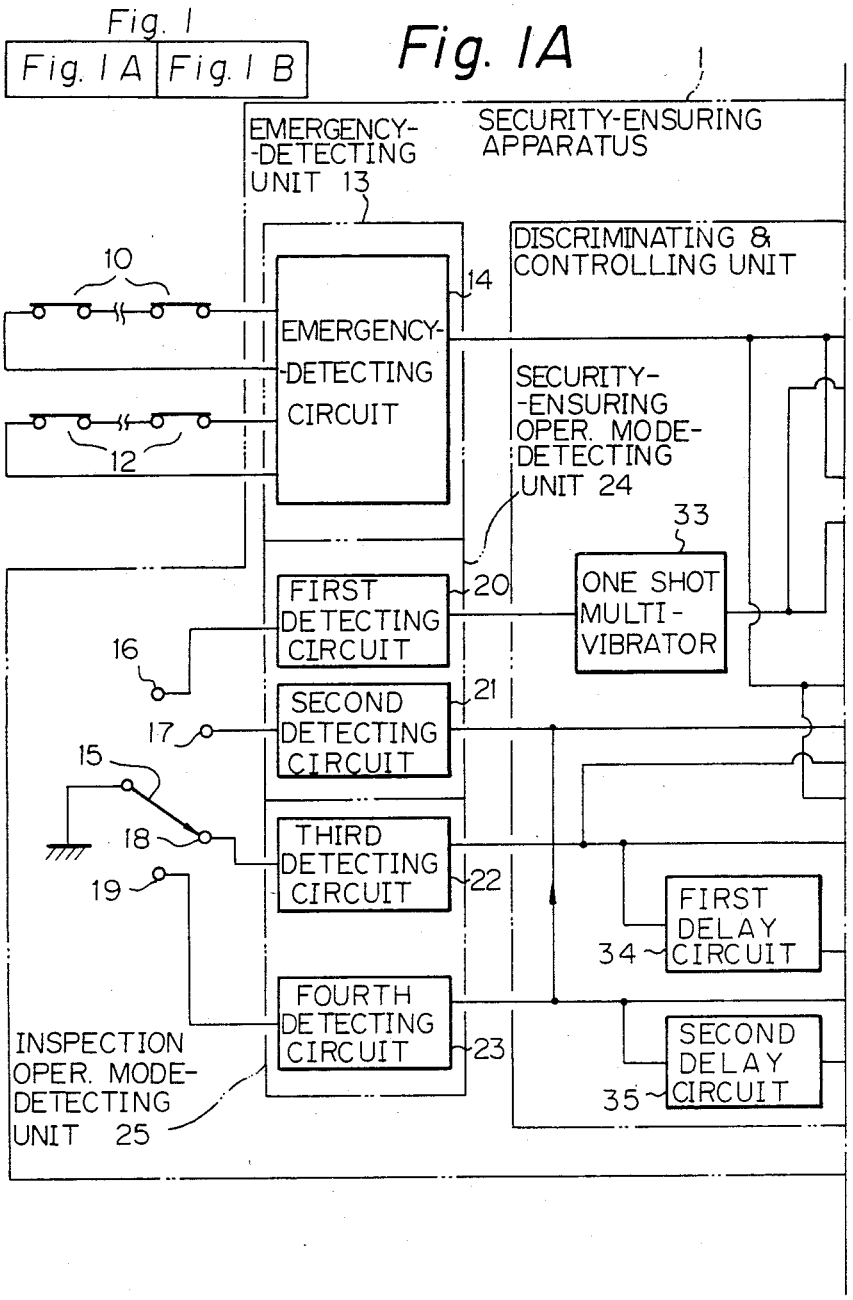
Fig. 1
Fig. 1 A
Fig. 1 B
Fig. 1A
1
SECURITY-ENSURING APPARATUS
EMERGENCY--DETECTING UNIT 13
DISCRIMINATING & CONTROLLING UNIT
10
14
EMERGENCY--DETECTING CIRCUIT
12
SECURITY--ENSURING OPER. MODE-DETECTING UNIT 24
33
FIRST DETECTING CIRCUIT
20
ONE SHOT MULTI-VIBRATOR
16
SECOND DETECTING CIRCUIT
21
17
15
18
THIRD DETECTING CIRCUIT
22
19
FIRST DELAY CIRCUIT
34
FOURTH DETECTING CIRCUIT
23
SECOND DELAY CIRCUIT
35
INSPECTION OPER. MODE-DETECTING UNIT 25

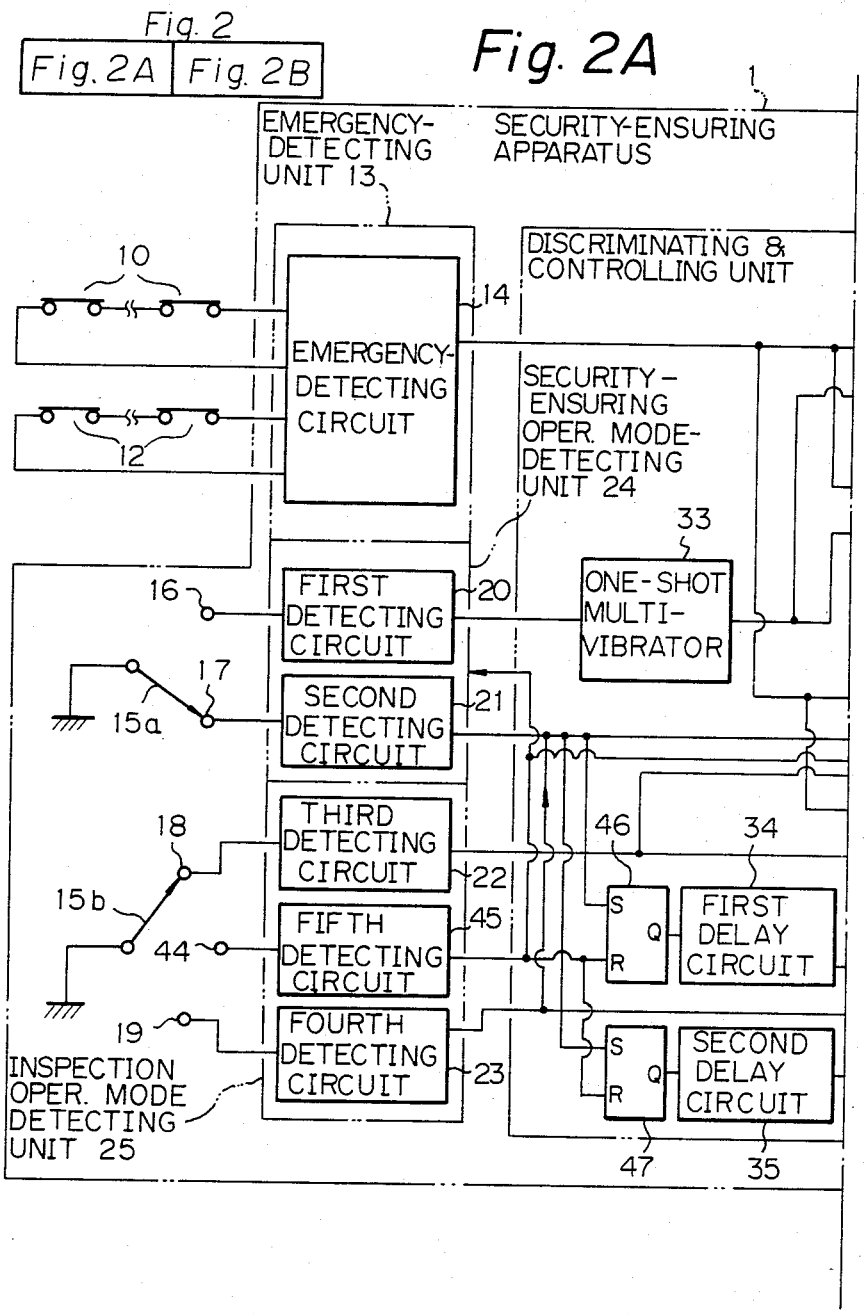
Fig. 2
Fig. 2A
Fig. 2B
Fig. 2A
1
SECURITY-ENSURING APPARATUS
EMERGENCY-DETECTING UNIT 13
DISCRIMINATING & CONTROLLING UNIT
10
14
EMERGENCY-DETECTING CIRCUIT
12
SECURITY-ENSURING OPER. MODE-DETECTING UNIT 24
33
16
FIRST DETECTING CIRCUIT
20
ONE-SHOT MULTI-VIBRATOR
17
15a
SECOND DETECTING CIRCUIT
21
18
THIRD DETECTING CIRCUIT
22
46
34
15b
44
FIFTH DETECTING CIRCUIT
45
S
Q
R
FIRST DELAY CIRCUIT
19
FOURTH DETECTING CIRCUIT
23
INSPECTION OPER. MODE DETECTING UNIT 25
SECOND DELAY CIRCUIT
47
35

| Fig. 3A | Fig. 3B |
|---|---|

MULTI-OPERATION MODE TYPE OF SECURITY-ENSURING APPARATUS

BACKGROUND OF THE INVENTION

1. Field of the Invention

The present invention relates to a security-ensuring apparatus for detecting an emergency or abnormality, such as fire, unauthorized entry, gas leakage, equipment failure, etc., occurring in a predetermined protected area and for sending an emergency or abnormality signal to a central monitoring station located distant from the predetermined protected area and to other associated equipment when such emergency or abnormality occurs. More particularly, the present invention relates to a security-ensuring apparatus which has multi-operation modes, including a security-ensuring operation mode and a management operation mode. In the management operation mode, the security-ensuring apparatus can automatically operate while being inspected by authorized engineers.

2. Description of the Prior Art

A conventional security-ensuring apparatus employed in an alarm system for protecting a predetermined area, such as the user's residence or office, usually has only two separate operation modes, i.e., a manned security-ensuring operation mode and an unmanned security-ensuring operation mode, which modes are switched from one to the other by the user of the apparatus or by authorized persons, such as dispatched engineers and patrol engineers. The manned security-ensuring operation mode is set when it is certain that there is a person or persons in the predetermined protected area capable of handling an emergency or abnormality. On the other hand, the unmanned security-ensuring operation mode of the security-ensuring apparatus is usually set when there is no one in the predetermined protected area who can handle an emergency or abnormality.

In the conventional security-ensuring apparatus, when the user or an engineer wishes to examine the apparatus, as part of the maintenance thereof, it is necessary, prior to the start of examination, to inform the central monitoring station by telephone the apparatus is going to be examined. When examination of the apparatus is completed, it is also necessary to inform the central monitoring station thereof.

During examination of the apparatus, diverse kinds of tests are carried out by the engineers, and, thus, test emergency information signals are automatically sent to the central monitoring station. Also, the apparatus per se is set to the above-mentioned manned security operation mode. Therefore, while the apparatus is being examined, if an actual emergency or abnormality occurs, an actual emergency information signal is sent to the central monitoring station without being discriminated from the above-mentioned test emergency information signals. Accordingly, the monitor of the central monitoring station determines the actual emergency information signal to be one of the test emergency information signals since the monitor cannot descriminate between the test emergency information signals and actual emergency information signals. Consequently, the monitor of the central monitoring station is unable to handle an actual emergency or abnormality occurring in the predetermined protected area. This is a serious drawback.

Further, the above-mentioned method of informing the central monitoring station by telephone of the start and completion of examination of the apparatus involves a drawback. That is, if the user or the engineer forgets to telephone the central monitoring station prior to the start of examination of the apparatus, all test emergency information signals sent from the security-ensuring apparatus to the central monitoring station are determined to be actual emergency information signals by the monitor of the central monitoring station. As a result, the central monitoring station dispatches an engineer or engineers to the predetermined protected area even though an actual emergency or an actual abnormality has not occurred in the area. This results in a tremendous increase in the cost of running the security-ensuring apparatus and its associated machines.

On the other hand, if the user or the engineer forgets to telephone the central monitoring station after the completion of examination of the security-ensuring apparatus, the monitor of the central monitoring station cannot discriminate whether the emergency information signals that he receives are actual emergency information signals or test emergency information signals. As a result, if the monitor mistakes an actual emergency information signal for a test emergency information signal, it is impossible to control the actual emergency or abnormality that has occurred in the predetermined protected area. This is a further drawback of the conventional apparatus.

In addition, it is quite usual for each emergency information signal issued from a given conventional security-ensuring apparatus to be recorded on a suitable recorder and be statistically processed later so that the statistical data of the operation of the given conventional security-ensuring apparatus can be evaluated. That is, the rate of incorrect operation to correct operation of the given conventional security-ensuring apparatus can be calculated. However, if many test emergency information signals are included in the recorded signals, the statistical data is worthless.

In the conventional security-ensuring apparatus, when the dispatched engineer or engineers inspect an emergency or abnormality that has occurred in the predetermined protected area and when the patrol engineers periodically inspect the apparatus, the apparatus is set to the manned security-ensuring operation mode. After the above-mentioned respective inspections, the conventional security-ensuring apparatus is again set to the manned security-ensuring operation mode or the unmanned security-ensuring operation mode, depending on the current condition of the protected area. If the apparatus per se is set to the manned security-ensuring operation mode, the dispatched engineer or engineers or the patrol engineers can easily enter the predetermined protected area without being monitored by the monitor of the central monitoring station. Therefore, it is impossible to prevent dispatched engineers or patrol engineers having an evil intent from entering the protected area. This is still another of the drawbacks of the conventional security-ensuring apparatus.

SUMMARY OF THE INVENTION

An object of the present invention is to provide a security-ensuring apparatus by which the diverse drawbacks of the conventional security-ensuring apparatus are eliminated.

Another object of the present invention is to provide a multi-operation mode type of security-ensuring apparatus which has a management operation mode in addition to a manned and an unmanned security-ensuring operation mode, the management operation mode including at least a maintenance mode or a patrol mode.

In accordance with the present invention, there is provided a security-ensuring apparatus for ensuring the security of a predetermined area in association with emergency sensors suitably arranged in the predetermined area and a central monitoring station located distant from the predetermined area. The apparatus comprises a unit for selectively setting an operation mode of the security-ensuring apparatus to a security-ensuring operation mode including a manned and an unmanned security-ensuring operation mode and a management operation mode including at least a maintenance mode or a patrol mode; an emergency-detecting unit connected to emergency sensors for electrically detecting an emergency or abnormality sensed by the emergency sensors and generating a corresponding electric signal; a controlling unit for discriminating whether or not the electric signal indicating an emergency or abnormality should be transmitted to the central monitoring station on the basis of which operation mode of the security-ensuring and management operation mode is set in the security-ensuring apparatus; and a signal-transmitting unit for sending an electric signal indicating an emergency or abnormality to the central monitoring station when the discriminating unit discriminates that the electric signal should be transmitted to the central monitoring station. The control unit comprises a delay circuit unit for establishing a predetermined time period for which the management operation mode of the apparatus should continue and a signal-generating unit for generating an additional-operation signal when the management operation mode continues for more than the predetermined time period. The security-ensuring apparatus further comprises a display unit for displaying at least the operation mode of the apparatus.

BRIEF DESCRIPTION OF THE DRAWINGS

The present invention will be more apparent from the ensuring description of the preferred embodiments, with reference made to the accompanying drawings, wherein:

Referring to FIG. 1, emergency sensors, such as unauthorized-entry sensors 10, fire sensors 12, etc., are arranged in a predetermined protected area and are connected to an emergency-detecting circuit 14 of an emergnecy-detecting unit 13 of a security-ensuring apparatus 1 so that an emergency or abnormality sensed by the emergency sensors is detected by the emergency-detecting circuit 14. The security-ensuring apparatus 1 has four separate switching contacts 16 through 19, to one of which contacts a switch 15 is selectively engaged by the operator of the apparatus 1. The contact 16 is used to set an unmanned security-ensuring operation mode, the contact 17 is used to set a manned security-ensuring operation mode, the contact 18 is used to set a maintenance mode, and the contact 19 is used to set a patrol mode. FIG. 1 illustrates a condition where the switch 15 is engaged with the switching contact 18 so as to set a maintenance mode in the apparatus 1. The respective operation modes set by the switch 15 and the four switching contacts 16 through 19 are respectivley detected by first through fourth detecting circuits 20 through 23. The first and second detecting circuits 20 and 21 form a security-ensuring operation mode-detecting unti 24, and the third and fourth detecting circuits 22 and 23 form a management operation mode-detecting unit 25. The security-ensuring apparatus 1 has a discriminating and controlling unit 26 arranged on the next stage of the emergency-detecting unit 13, the security-ensuring operation mode-detecting unit 24, and the management operation mode-detecting unit 25. The discriminating and controlling unit 26 comprises first through fourth AND gates 27 through 30, a NAND gate 31, an inverter circuit 32, a one-shot multivibrator 33, first and second delay circuits 34 and 35, an incorrect-operation signal-generating circuit 36, a discriminating circuit 37, an additional-maintenance signal-generating circuit 38, an additional-patrolling singal-generating cirucit 39, and a memory unit 40 which are electrically interconnected to one another as shown in FIG. 1. The apparatus 1 also has a display unti 41 and a signal-transmitting circuit 42 connected to the discriminating and controlling unit 26. The signal-transmitting circuit 42 is provided for sending an electric signal indicating an emergency in the predetermined protected area to a central monitoring station 43 located far from the predetermined protected area. Naturally, the central monitoring station 43 also receives emergency information signals from other similar security-ensuring apparatuses. The emergency-detecting circuit 14 generates an electric signal upon the detection of an emergency sensed by emergency sensors such as the sensors 10, 12, etc.. The electric signal is sent to the first AND gate 27, the discriminating circuit 37, and the NAND gate 31. At this stage, if it is discriminated by the dicriminating circuit 37 that the electric signal indicates a fire sensed by the fire sensors 12, the electric signal is sent, as a prior signal, to the signal-transmitting circuit 42 irregardless of the mode of the manned and unmanned security-ensuring operation modes and the patrolling mode of the management operation mode set in security-ensuring apparatus. If it is discriminated by the discriminating circuit 37 that the electric signal generated by the emergency-detecting circuit 14 indicates an unauthorized entry sensed by the unauthorized-entry sensors 10, the electric signal is sent to the signal-transmitting circuit 42 only when the manned security-ensuring operation mode or the unmanned security-ensuring operation mode is set in the security-ensuring apparatus 1.

Figure 1B:
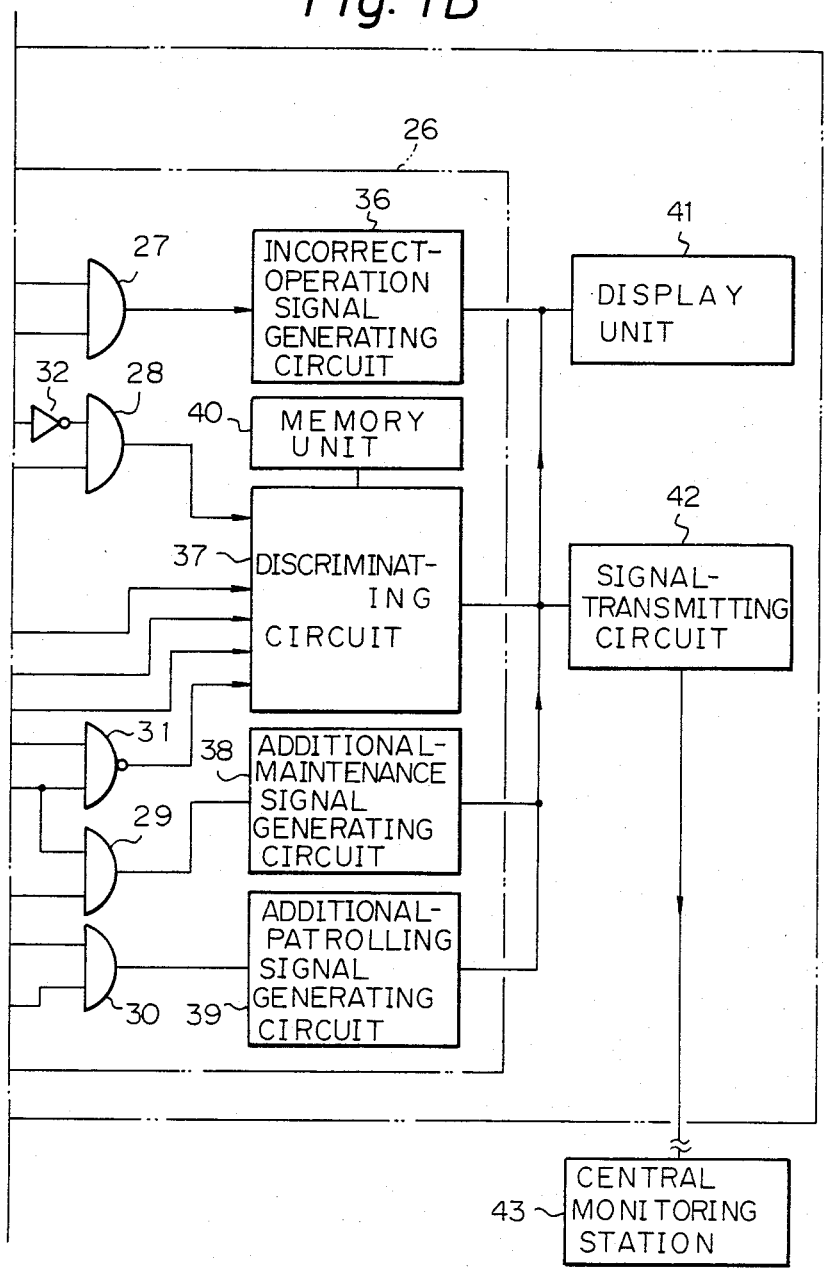
FIG. 1 is a block diagram of a multi-operation mode type of security-ensuring apparatus according to an embodiment of the present invention.

When the switch 15 of the apparatus 1 engages with the switching contact 16 so as to set the unmanned security-ensuring operation mode, the firt detecting circuit 20 of the security-ensuring operation mode-detecting unit 24 detects the fact that the switch 15 has engaged with the contact 16 and sends a detecting signal to the one-shot multivibrator 33 so as to drive the one-shot multivibrator 33. Therefore, the multivibrator 33 sends a signal, e.g., a high-level signal, to both the first and second AND gates 27 and 28. At this stage, if the emergnecy-detecting circuit 14 of the emergnecy-detecting unit 13 detects an emergnecy, such as the opening of a window or windows, the opening of a door or doors, etc., which should not be detected at the start of the unmanned security-ensuring operation mode, the emergnecy-detecting circuit 14 generates an electric signal which is sent to the first AND gate 27. As a result, the first AND gate 27 generates, at its output terminal, an electric output signal which is sent to the incorrect-operation signal-generating circuit 36. The incorrect-operation signal-generating circuit 36 then sends a signal to the display unit 41 so that the display unit 41 indicates an emergency by turing on alarm lamps and/or sounding alarm buzzers. The cirucit 36 also sends an identical signal to the signal-transmiting circuit 42 so that the circuit 42 transmits to the central moitoring station 43 an electric signal indicating incorrect operation of the apparatus 1 by the operator.

On the other hand, when the emrgency-detecting circuit 14 does not detect an emergnecy or abnormality based on the above-mentioned incorrect operation of the apparatus 1, a high-level signal is sent from the output terminal of the emergnecy-detecting circuit 14 to the second AND gate 28 via the inverter 32. As a result, the second AND gate 28 generates, at its output terminal, a high-level output signal which is sent to the discriminating circuit 37. Accordingly, the discriminating circuit 37 operates the display unit 41 so that the display unit 41 indicates that the unmanned security-ensuring operation mode is set in the apparatus 1 and concurrently operates the signal-transmitting circuit 42 so as to send a signal indicating the start of the unmanned security-ensuring operation mode to the central monitoring station 43. The unmanned security-ensuring operation mode is then stored in the memory unit 40 as a current operation mode of the apparatus 1.

When the switch 15 engages with the contact 17, the second detecting circuit 21 detects the fact that the manned security-ensuring operation mode is set in the apparatus 1 and sends a signal indicating this to the discriminating circuit 37. The circuit 37 then operates the display unit 41 so that the display unit 41 indicates, by turning on the alarm lamps, that the manned security-ensuring operation mode is set. The discriminating circuit 37 also operates the signal-transmitting circuit 42 so that the circuit 42 transmits to the central monitoring station 43 a signal indicating that the manned security-ensuring operation mode is set. The manned security-ensuring operation mode is then stored in the memory unit 40 as a current operation mode of the apparatus 1.

Next, when the switch 15 engages with the contact 19, the fourth detecting circuit 23 of the management operation mode-detecting unit 25 detects the fact that the patrol mode is set in the security-ensuring apparatus 1 and sends a signal indicating this to the discriminating circuit 37. The discriminating circuit 37 then operates the display unit 41 so that the display unti 41 indicates the patrol mode and also operates the signal-transmitting circuit 42 so that the circuit 42 transmits to the central monitoring station 43 a signal indicating that patrol mode is set. The patrol mode is then stored in the memory unit 40 as a current operation mode of the apparatus 1.

In any one of the above-mentioned three operation modes, i.e., manned security-ensuring operation mode, the unmanned security-ensuring operation mode, and the patrol mode, if the unauthorized-entry sensors 10 sense an unauthorized entry, the emergency-detecting circuit 14 detects the emergency and generates an electric signal indicating unauthorized entry. The electric signal is then input into one of the input terminals of the NAND gate 31. The other input terminal of the NAND gate 31 is connected to the third detecting circuit 22 for detecting the maintenance mode. Therefore, the NAND gate 31 generates, at its output terminal, an output signal indicating an unauthorized entry, which signal is sent to the discriminating circuit 37. In the discriminating circuit 37, it is discriminated whether or not the output signal from the NAND gate 31 should be transmitted to the central monitoring station 43, via the signal-transmitting circuit 42, on the basis of the current operation mode of the apparatus 1 stored in the memory unit 40. That is, in a case where the current operation mode is the unmanned security-ensuring operation mode, the above-mentioned signal indicating an unauthorized entry is transmitted to the station 43. However, in a case where the current operation mode of the security-ensuring apparatus 1 is the manned security-ensuring operation mode, the above-mentioned signal indicating an unauthorized entry is not transmitted to the central monitoring station 43 since it is evident that someone is in the predetermined protected area.

In a case where the current operation mode of the security-ensuring apparatus 1 is the patrol mode, the above-mentioned signal indicating an unauthorized entry is also not transmitted to the central monitoring station since the patrol engineers per se are assumed to be aware of an unauthorized entry.

When the security-ensuring apparatus 1 is set in the manned security-ensuring operation mode, the unmanned security-ensuring operation mode, or the patrol mode, if the fire sensors 12 sense a fire, the emergency-detecting circuit 14 immediately detects the fire and generates an electric signal indicating a fire. Therefore, the NAND gate 31 receives at its one input terminal the electric signal indicating a fire. At this stage, since the other input terminal of the NAND gate 31 does not receive any signal from the third detecting circuit 22 that generates a signal upon detection of only the maintenance mode, the NAND gate 31 generates, at its output terminal, an output signal indicating a fire. This outut signal is sent to the discriminating circuit 37. Thus, the discriminating circuit 37 operates both the display unit 41 and the signal-transmitting circuit 42 as long as the current operation mode of the security-ensuring apparatus 1 stored in the memory unit 40 is the manned security-ensuring operation mode, the unmanned security-ensuring operation mode, or the patrol mode. The display unit 41 then indicates a fire by turning on the alarm lamps and sounding the alarm buzzers, and the signal-transmitting circuit 42 transmits a fire signal to the central monitoring station 43. The fire signal is also stored in the memory unit 40 as a signal indicating a current condition of the predetermined area.

When the switch 15 engages with the switching contact 18, the third detecting circuit 22 of the management operation mode-detecting unit 25 detects the fact that the maintenance mode is set in the security-ensuring apparatus 1 and generates an electric signal indicating this. The electric signal is then sent to the discriminating circuit 37 and also to the NAND gate 31, the third AND gate 29, and the first delay circuit 34. Therefore, the discriminating circuit 37 registers the maintenance mode in the memory unit 40 as the current operation mode of the apparatus 1. The discriminating circuit 37 also operates both the display unit 41 and the signal-transmitting circuit 42. That is, the display unit 41 displays the maintenance mode, and the signal-transmitting circuit 42 transmits to the central monitoring station 43 a signal indicating that the maintenance mode is set.

When the first delay circuit 34 receives an electric signal from the third detecting circuit 22, it generates an output signal after a predetermined delay time that is determined and set by taking into account the extent of the predetermined area protected by the security-ensuring apparatus 1. The output signal of the first delay circuit 34 is then supplied to the third AND gate 29. Therefore, when the third AND gate 29 receives the output signal from the first delay circuit 34, if the gate 29 also receives an electric signal from the third detecting circuit 22, there appears at the output terminal of the third AND gate 29 an output signal which indicates the fact that the maintenance mode has continued for more than the predetermined time period set by the first delay circuit 34. The output signal of the third AND gate 29 is sent to the additional-maintenance signal-generating circuit 38. The circuit 38 then generates a signal indicating that the maintenance mode has continued for longer than the predetermined time set by the first delay circuit 34. The signal of the additional-maintenance signal-generating circuit 38 is sent to both the display unit 41 and the signal-transmitting circuit 42. Therefore, the display unit 41 indicates that the predetermined time period of the maintenance mode has passed. The signal-transmitting circuit 42 transmits to the central monitoring station 43 a signal indicating that the maintenance mode has continued for longer than the predetermined time. Therefore, the central monitoring station 43 is informed of the additional-maintenance mode and is able to initiate a necessary security-ensuring operation to ascertain whether or not the engineers forgot to operate the switch 15 at the end of the maintenance mode.

On the other hand, when the electric signal of the third detecting circuit 22 is input into one of the input terminals of the NAND gate 31, if the other input terminal of the NAND gate 31 receives an electric signal from the emergency-detecting circuit 14 of the emergency-detecting unit 13, the NAND gate 31 does not generate an output signal at its output terminal. Therefore, no signal is input from the NAND gate 31 into the discriminating circuit 37. This means that while the maintenance mode is set in the security-ensuring apparatus 1, each electric signal indicating an emergency or abnormality is considered to be a test emergency signal and is not sent to the discriminating circuit 37. That is, the NAND gate 31 operates so as to cancel every emergency or abnormality signal during the maintenance mode. It should be understood that in the maintenance mode since the maintenance operation is conducted by the engineeers, no problem occurs even if an emergency detected by the emergency-detecting circuit 14 is considered to be merely a test emergency due to the maintenance operation and not an actual emergency. Accordingly, no emergency signal is transmitted from the signal-transmitting circuit 42 to the central monitoring station.

It will be understood from the foregoing description that the multi-operation mode type of security-ensuring apparatus 1 according to the first embodiment of the present invention is characterized in that in the maintenance mode of the management operation mode, an emergency signal is not sent to the central monitoring station. The security-ensuring apparatus 1 may have an alternative form as described hereinafter with reference to FIGS. 1 and 4.

If the NAND gate 31 of FIG. 1 is replaced with a combination of an AND gate 310 and a signal identification circuit 311, a signal indicating the maintenance mode is generated by the third detecting circuit 22 and is sent to one of the input terminals of the AND gate 310 when the switch 15 engages with the contact 18. Therefore, if an emergency signal is input from the emergency-detecting circuit 14 into the other input terminal of the AND gate 310, an output signal indicating an emergency or abnormality appears at the output terminal of the AND gate 310. Although this signal of the AND gate 310 is only a test emergency or abnormality signal, it is sent to the signal identification circuit 311, in which an identification code indicating a test emergency during the maintenance mode is added to the signal of the AND gate 310. Thereafter, the signal having the identification code is sent to the central monitoring station 43 via the discriminating circuit 37 and the signal-transmitting circuit 42. Therefore, the central monitoring station 43 can determine whether or not the signal having the identification code is an emergency signal generated during the maintenance mode of the security-ensuring apparatus. For example, if the identification code includes the machine code of the present security-ensuring apparatus 1, it is possible for the monitor to obtain an accurate and clear recording of the user's security-ensuring apparatus 1 when the apparatus 1 is subjected to a maintenance operation. As a result, control of the maintenance operation for each security-ensuring apparatus is ensured. Further, since the above-mentioned emergency signal having an identification code can readily be distinguished from an actual emergency signal, when the operation of each security-ensuring apparatus 1 is statistically calculated, it is possible to omit test emergency data from the actual emergency data. Accordingly, the accuracy of statistical calculation can be high.

Referring again to FIG. 1, when the switch 15 engages with the switching contact 19, the fourth detecting circuit 23 sends an electric signal indicating the patrol mode to both the fourth AND gate 30 and the second delay circuit 35. At this stage, the second delay circuit 35 generates an output signal after a predetermined delay time that determines the time period of the patrol mode of the security-ensuring apparatus 1. The signal of the second delay circuit 35 is then sent to the fourth AND gate 30. Therefore, it is understood that if the patrol mode continues for more than the predetermined time period, the fourth AND gate 30 generates, at its output, an output signal which is sent to the additional-patrolling signal-generating circuit 39. As a result, the additional-patrolling signal is displayed by the display unit 41 and is concurrently sent to the central monitoring station 43 via the signal-transmitting circuit 42. Therefore, the monitor of the central monitoring station 43 is made aware of the fact that the patrol mode of the security-ensuring apparatus 1 was longer than the predetermined time period and is able to execute a necessary security-ensuring action.

From the foregoing descritpin, it will be understood that according to the multi-operation mode type of security-ensuring apparatus 1 of the present invention, the management operation mode including the maintenance and petrol modes can be automatically set by manual operation of the switch 15. In addition, termination of the management operation mode is monitored by the central monitoring station. Therefore, it is unnecessary to inform the central monitoring station by telephone of the termination of the management operation mode, and the occurrence of trouble due to the central monitoring station not being informed of the termination of the management operation mode can be avoided. In addition, since the time period of the patrol mode of the security-ensuring apparatus 1 is monitored by the central monitoring station 43, if the time period exceeds the predetermined time, the monitor is immediately made aware of the additional-patrol mode. Therefore, the safety of the patrol engineers can be guaranteed.

Figure 2B:
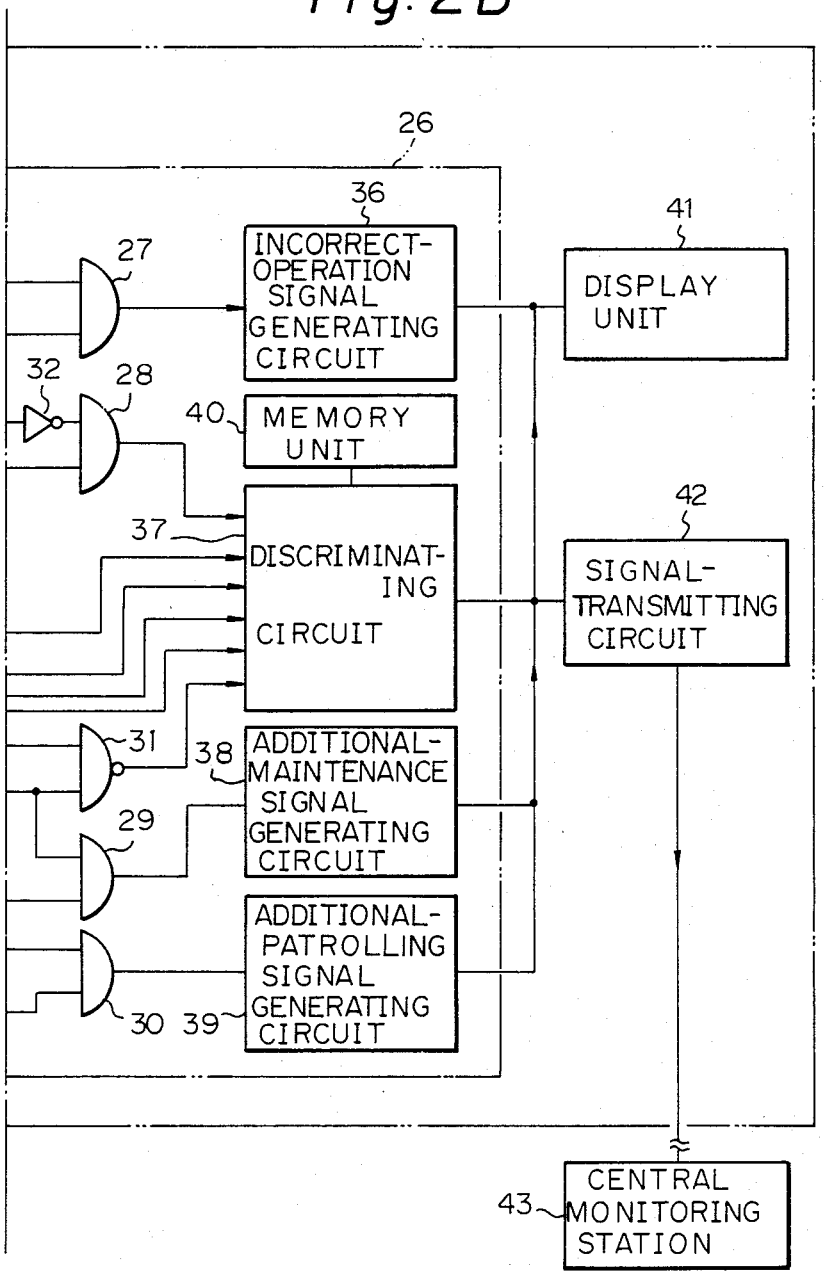
FIG. 2 is a block diagram of a multi-operation mode type of security-ensuring apparatus according to another embodiment of the present invention.

FIG. 2 illustrates the second embodiment of the security-ensuring apparatus of the present invention. In FIG. 2, the same reference numerals as those of FIG. 1 designate the same units and circuits as those of FIG. 1.

The security-ensuring apparatus of the second embodiment is different from that of the first embodiment in that there are provided two switches 15*a* and 15*b*, the switch 15*a* being used to set both the manned security-ensuring operation mode and the unmanned security-ensuring operation mode in the apparatus 1 and the switch 15*b* being used to set the intermission mode of the management operation mode in addition to the aforementioned maintenance mode and patrol mode of the management operation mode in the apparatus 1. A switching contact 44 is used to set the intermission mode and is connected to a fifth detecting circuit 45. That is, the fifth detecting circuit 45 is provided for detecting the setting of the intermission mode by the switch 15*b*. The security-ensuring apparatus of FIG. 2 is also different from that of FIG. 1 in that there are provided first and second flip-flop circuits 46 and 47 in the discriminating and controlling unit 26.

The operation of the security-ensuring apparatus of FIG. 2 is described hereinbelow by taking the above-mentioned difference in construction between the first and second embodiments into account.

In the apparatus 1 of FIG. 2, the switch 15*a* is manually engaged with either of the contacts 16 and 17 in order to set the unmanned or the manned security-ensuring operation mode. The setting of the unmanned security-ensuring operation mode is detected by the first detecting circuit 20, and the setting of the manned security-ensuring operation mode is detected by the second detecting circuit 21. The switch 15*b* is manually engaged with either of the contacts 18, 19, and 44 in order to set the maintenance mode, the patrol mode, and the intermission mode, respectively. The setting of the above-mentioned three modes of the management operation mode is detected by the third through fifth detecting circuits 22, 23, and 45, respectively. It should be understood that the switch 15*b* may be engaged with any of the contacts 18, 19, and 44 irrespective of the switch 15*a*. It should, however, be noted that, in most cases, the management operation is conducted while the apparatus 1 is set in the manned security-ensuring operation mode. That is, in most cases, the setting of the maintenance mode or the patrol mode by the switch 15*b* takes place while the switch 15*a* is engaged with the contact 17 for setting the manned security-ensuring operation mode.

When the switch 15*a* engages with the contact 17, the second detecting circuit 21 generates an electric signal which is sent to the set terminal S of the first and second flip-flop circuits 46 and 47. As a result, the first and second flip-flop circuits 46 and 47 are operated, and an output signal, i.e., a high-level signal, appears at the respective output terminals Q of the first and second flip-flop circuits 46 and 47. Under such a condition, if the switch 15*b* is disengaged from the switching contact 18 and is engaged with the contact 44 at the end of the maintenance mode, an electric signal generated by the fifth detecting circuit 45 is input into the reset terminal R of the first flip-flop circuit 46. As a result, the output signal disappears from the output terminal Q of the circuit 46. Therefore, the operation of the first delay circuit 34 is automatically stopped. Accordingly, no output signal appears at the output terminal of the third AND gate 29. Consequently, the additional-maintenance signal-generating circuit 38 does not operate. That is, when the intermission mode is set in the apparatus 1 by the switch 15*b*, no additional-maintenance signal is generated by the circuit 38.

On the other hand, at the end of the patrol mode, if the switch 15*b* is disengaged from the contact 19 and is engaged with the contact 44 so as to set the intermission mode, an electric signal generated by the fifth detecting circuit 45 is input into the reset terminal R of the second flip-flop circuit 47 so as to stop operation of the flip-flop circuit 47. Thus, no additional-patrolling signal is eventually generated by the additional-patrolling signal-generating circuit 39. That is, termination of the patrol mode is ensured by disengagement of the switch 15*b* from the contact 19 and engagement of the switch 15*b* with the contact 44.

It should here be noted that when the switch 15*b* disengages from either of the contacts 18 and 19 and engages with the contact 44, an electric signal indicating the intermission mode is sent to the security-ensuring operation mode-detecting unit 24. That is, the electric signal is used for determining whether the unmanned security-ensuring operation mode or the manned security-ensuring operation mode is set by the switch 15*a* in the apparatus 1 at the moment of setting of the intermission mode by the switch 15*b*. Upon receipt of the electric signal indicating the intermission mode, either the first detecting circuit 20 or the second detecting circuit 21 of the unit 24 generates an electric signal at the output terminal thereof. This electric signal is processed by the discriminating and controlling unit 26 in the same manner as the aforementioned case where the switch 15 of the first embodiment (FIG. 1) engages with the contact 16 or 17. Thus, depending on the position of the switch 15*a*, the display unit 41 indicates whether the current operation mode of the security-ensuring apparatus 1 is set in the manned security-ensuring operation mode or in the unmanned security-ensuring operation mode. At the same time, the signal-transmitting circuit 42 transmits a signal to the central monitoring station, indicating whether the current operation mode of the apparatus 1 is set in the manned security-ensuring operation mode or in the unmanned security-ensuring operation mode.

From the foregoing description, it will be understood that in the security-ensuring apparatus of the second embodiment, it is possible for engineers or patrol engineers to confirm termination of the maintenance and patrol modes of the management operation mode by manually operating the switch 15*b*.

Further, since there are provided two separate switches 15*a* and 15*b* for respectively setting the security-ensuring operation mode and the management operation mode, it is possible for the engineers to confirm whether the manned security-ensuring operation mode or the unmanned security-ensuring operation mode is set in the security-ensuring apparatus 1 at the completion of maintenance of the apparatus 1.

Figures 3, 3A:
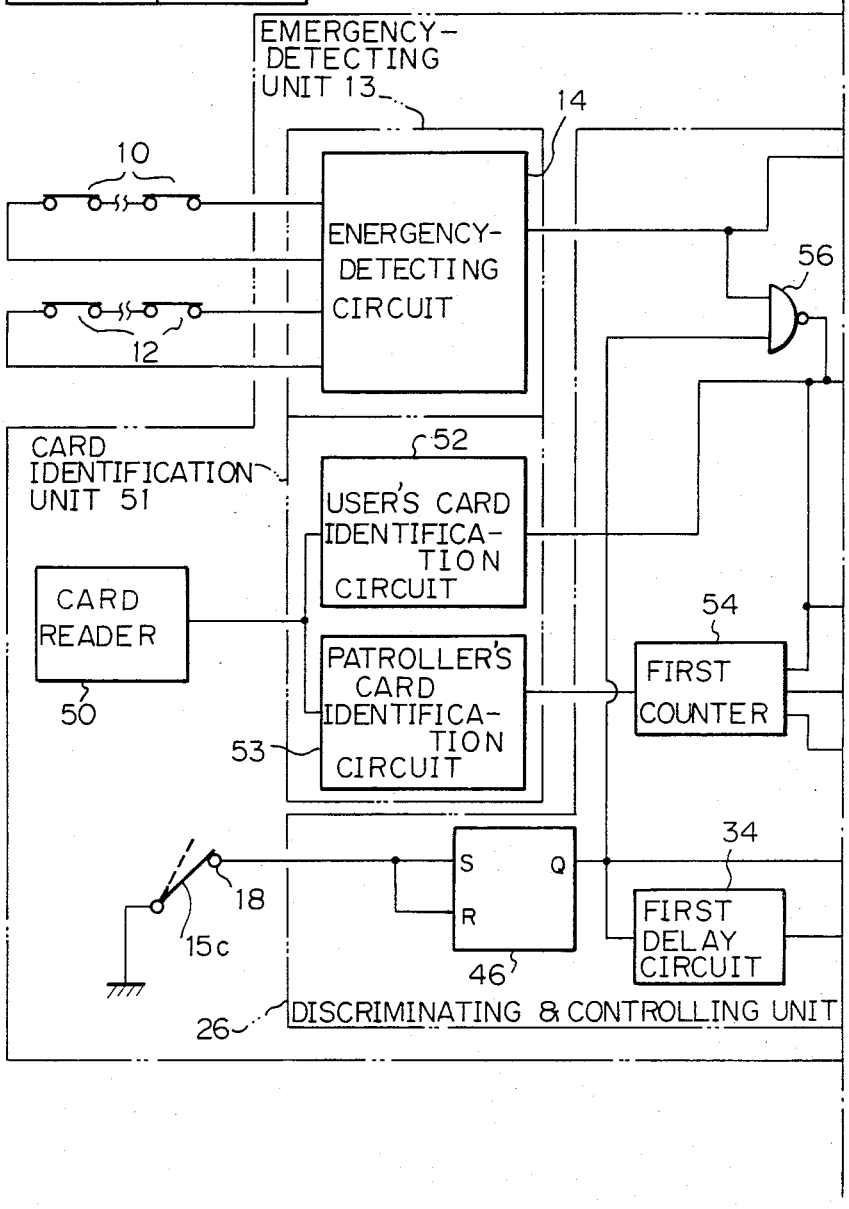
FIG. 3 is a block diagram of a multi-operation mode type of security-ensuring apparatus according to a further embodiment of the present invention.
Figure 3B:
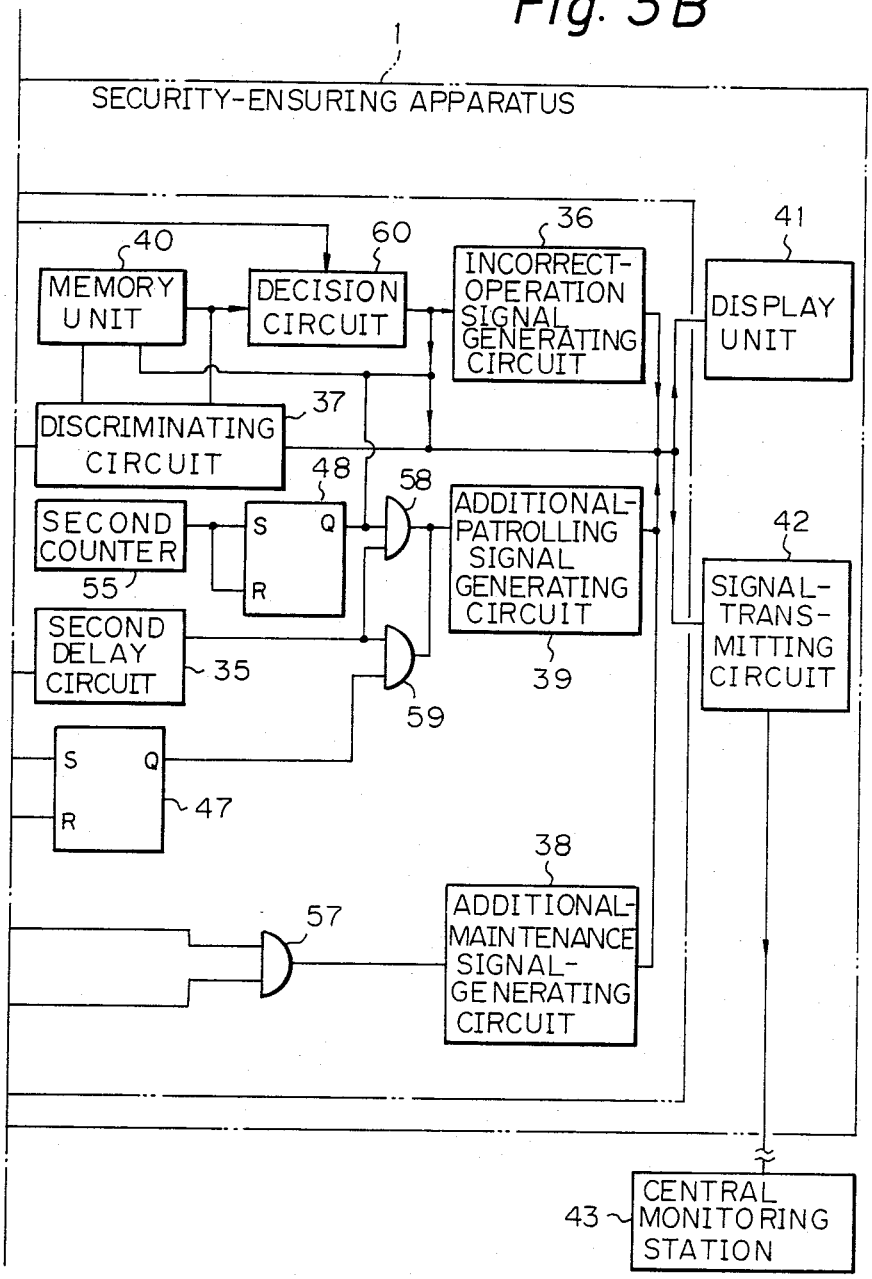

FIG. 3 illustrates the security-ensuring apparatus according to the third embodiment of the present invention. In this embodiment, the same reference numerals as those in the first and secod embodiments designate the same elements, units, and circuits as those of the first and second embodiments.

It should be noted that the apparatus of FIG. 3 is characterized in that the setting of the manned and unmanned security-ensuring operation modes, as well as the setting of the patrol mode of the management operation mode, is conducted by the use of an identification card, such as a known magnetic card. Therefore, the apparatus 1 of the present embodiment is provided with a card reader 50 and a switch 15*c* for setting the maintenance mode of the management operation mode in the apparatus 1. The card reader 50 is connected to both a user's card identification circuit 52 and a patroller's card identification circuit 53 of a card identification unit 51 so that a card read by the card reader 50 is identified by the two circuits 52 and 53. In the apparatus 1 of the present embodiment, a discriminating and controlling unit 26 comprises a discriminating circuit 37, a memory unit 40, a first counter 54, a second counter 55, a first delay circuit 34, a second delay circuit 35, first thrugh third flip-flop circuits 46 through 48, a NAND gate 56, first through third AND gates 57 through 59, a decision circuit 60, an incorrect-operation signal-generating circuit 36, an additional-maintenance signal-generating circuit 38, and an additional-patrolling signal-generating circuit 39 which are interconnected to one another as shown in FIG. 3.

In the security-ensuring apparatus of the third embodiment of FIG. 3, the user is requested to use a predetermined user's card that is preliminarily prepared for the user's apparatus, and the patrol engineers are requested to use a predetermined patroller's card that is preliminarily prepared for each individual apparatus 1. The user's card is designed and made so that when it is inserted into the card reader 50 the manned security-ensuring operation mode and the unmanned security-ensuring operation mode are alternately set in the corresponding apparatus 1. The patroller's card is designed and made so that when it is inserted into the card reader 50 the operation mode of the corresponding apparatus is switched either from the manned or unmanned security-ensuring operation mode to the patrol mode or from the patrol mode to the unmanned security-ensuring operation mode. Therefore, the patrol engineers are allowed to enter the predetermined protected area only when it is necessary that they handle an emergency or abnormality that has occurred in the predetermined area or carry out periodic management of the apparatus 1. That is, unauthorized entry of the patrol engineers per se into the predetermined protected area can definitely be prevented.

The operation of the security-ensuring apparatus 1 of the third embodiment is described hereinbelow.

When the user inserts his card into the card reader 50, the user's card identification circuit 52 judges whether or not it is a predetermined one. If it is identified as being the predetermined user's card, the circuit 52 sends an electric signal to the discriminating circuit 37, and upon receipt of the electric signal, the circuit 37 reads the current operation mode of the apparatus 1 out of the memory unit 40. If the current operation mode read out of the memory unit 40 is the manned security-ensuring operation mode, and if the second counter 55 records zero, the discriminating circuit 37 sends a signal to the decision circuit 60. At this stage, the decision circuit 60 is connected to the emergency-detecting circuit 14. If there is no emergency or abnormality, such as an open window, an open door, etc., in the predetermined protected area, no electric signal is input from the circuit 14 into the circuit 60. As a result, the decision circuit 60 decides, on the basis of the signal from the discriminating circuit 37, that the manned security-ensuring operation mode can be switched to the unmanned security-ensuring operation mode and sends a signal to the display unit 41 and to the signal-transmitting circuit 42. The display unit 41 then displays the unmanned security-ensuring operation mode, and the signal-transmitting circuit 42 transmits to the central monitoring station 43 a signal indicating that the operation mode of the apparatus has switched from the manned to the unmanned security-ensuring operation mode. At this time, the current operation mode stored in the memory unit 40 is changed from the manned to the unmanned security-ensuring operation mode.

On the other hand, upon the receipt of the electric signal from the discriminating circuit 37, if the decision circuit 60 also receives an emergency-indicating signal from the circuit 14, the decision circuit 60 sends a signal to the incorrect-operation signal-generating circuit 36 so that the circuit 36 generates an incorrect-operation signal which is sent to both the display unit 41 and the signal-transmitting circuit 42. As a result, the display unit 41 indicates incorrect operation of the apparatus by the user, i.e., that the user has switched the operation mode of the apparatus from the manned to the unmanned security-ensuring operation mode without determining whether or not an emergency or abnormality exists in the predetermined protected area. Further, the circuit 42 transmits to the central monitoring station 43 a signal indicating incorrect operation of the apparatus. Consequently, the user is made aware of incorrect operation of the apparatus by the display unit 41. Thus, after the user determines whether or not an emergency or abnormality exists in the predetermined protected area, the user again inserts the user's card so that the apparatus 1 can be set in the unmanned security-ensuring operation mode.

Naturally, if the user's card inserted into the card reader 50 is not a predetermined user's card, this fact is detected by the user's card identification circuit 52 and the operation mode of the security-ensuring apparatus cannot be switched.

If the user inserts his predetermined user's card into the card reader 50 while the current operation mode of the apparatus 1 is the unmanned security-ensuring operation mode, the discriminating circuit 37 of the discriminating and controlling unit 26 sends a signal to the display unit 41 and the signal-transmitting circuit 42 so that the unit 41 displays the manned security-ensuring operation mode and so that the circuit 42 transmits to the central monitoring station 43 a signal indicating that the operation mode is switched from the unmanned to the manned security-ensuring operation mode. Concurrently, the current operation mode stored in the memory unit 40 is changed from the unmanned to the manned security-ensuring operation mode. Thereafter, the security-ensuring apparatus 1 executes the manned security-ensuring operation in association with the emergency sensors 10 and 12 and the central monitoring station 43.

When the patrol engineers enter the predetermined protected area to periodically inspect the apparatus 1 or to bring an emergency or abnormality under control, the patroller's card is initially inserted into the card reader 50. The patroller's card identification circuit 53 then judges whether or not the inserted patroller's card is a correct predetermined one. If it is not correct, the patrol mode is not set in the apparatus 1. Thus, the patrol engineers are prevented from entering the predetermined protected area.

If the circuit 53 determines that the inserted patroller's card is a correct one, it sends a signal to the first counter 54 so as to set "1" in the counter 54, and the counter 54 immediately sends a signal to the set terminal S of the second flip-flop circuit 47, as well as to the second delay circuit 35. Thus, an output signal appears at the output terminal Q of the circuit 47 and is sent to one of the input terminals of the third AND gate 59. The other input terminal of the third AND gate 59 receives a signal from the second delay circuit 35 after a predetermined delay time set by the circuit 35. The first counter 54 also sends a signal to the discriminating circuit 37. The circuit 37 then operates the display unit 41 and the signal-transmitting circuit 42 irregardless of whether the unmanned security-ensuring operation mode or the manned security-ensuring operation mode is stored in the memory unit 40 as the current operation mode of the apparatus 1. Accordingly, the display unit 41 indicates that the patrol mode has been set in the apparatus 1 as the current operation mode. Further, the signal-transmitting circuit 42 sends to the central monitoring station a signal indicating that the current operation mode of the apparatus 1 has been switched to the patrol mode. It should, however, be noted that the current operation mode stored in the memory unit 40 is not changed to the patrol mode. While the patrol mode is set in the apparatus 1, the patrol engineers have to execute the necessary patrol operations, such as periodic management of the apparatus 1, bringing an emergency or abnormality that has occurred in the predetermined protected area under control, etc..

When the patrol engineers complete the necessary patrol operations, they again insert the predetermined patroller's card into the card reader 50. The patroller's card identification circuit 53 immediately generates a signal and sends it to the first counter 54. The first counter 54 is then reset to zero. Therefore, a signal is input from the first counter 54 into the reset terminal R of the second flip-flop circuit 47 so that the output signal disappears at the output terminal Q of the circuit 47. Accordingly, the third AND gate 59 no longer receives a signal from the second flip-flop circuit 47. At this stage, if the above-mentioned output signal of the circuit 47 disappears, i.e., if the input signal from the circuit 47 to the third AND gate 59 disappears, prior to the aforementioned sending of a delayed signal from the second delay circuit 35 to the third AND gate 59, no output signal appears at the output terminal of the AND gate 59. Accordingly, the additional-patrolling signal-generating circuit 39 is not driven and generates no additional-patrolling signal. This means that if the patrol mode is brought to an end within a predetermined time period set by the second delay circuit 35, no additional-patrolling signal is generated by the circuit 39.

On the contrary, if the sending of the delayed signal from the second delay circuit 35 to the third AND gate 59 occurs prior to the disappearance of the input signal from the second flip-flop circuit 47 to the AND gate 59, a signal appears at the output of the AND gate 59 as soon as the AND gate 59 receives the delayed signal from the circuit 35. As a result, the additional-patrolling signal-generating circuit 39 is operated so as to generate an additional patrolling signal at its output. The additional-patrolling-signal is accordingly sent to the display unit 41 and the signal-transmitting circuit 42. That is, the additional patrolling of the patrol engineers is displayed by the display unit 41 and is automatically transmitted to the central monitoring station 43 via the signal-transmitting circuit 42. This means that if the patrol operations of the patrol engineers are not completed within a predetermined time period, i.e., if the patrol engineers do not insert the patroller's card into the card reader 50 within a predetermined time period of the patrol mode, the central monitoring station 43 immediately is made aware of the occurrence of an unexpected abnormality in the predetermined protected area and, thus, is able to deal with it. Accordingly, the safety of the patrol engineers is ensured even in a case where they execute the necessary patrol operations in an unmanned predetermined protected area.

When the patroller's card is inserted into the card reader 50 at the end of the patrol mode, the first counter 54 sends a signal to the discriminating circuit 37. The discriminating circuit 37 then reads the current operation mode of the apparatus 1 out of the memory unit 40. If the read current operation mode is the unmanned security-ensuring operation mode, the circuit 37 sends a signal to the decision circuit 60, as well as to the display unit 41 and the signal-transmitting circuit 42. As a result, the display unit 41 immediately displays the unmanned security-ensuring operation mode, and, at the same time, the signal-transmitting circuit 42 sends to the central monitoring station 43 a signal indicating the unmanned security-ensuring operation mode. Therefore, the central monitoring station 43 is informed of the termination of the patrol mode and of restoration of the current operation mode of the security-ensuring apparatus to the unmanned security-ensuring operation mode.

On the other hand, if the aforementioned read current operation mode is the manned security-ensuring operation mode, the discriminating circuit 37 sends to the second counter 55 a signal to set "1" in the counter 55. As a result, the second counter 55 sends a signal to the set terminal S of the third flip-flop circuit 48 so that an output signal appears at the output terminal Q of the circuit 48. Thereafter, when the user inserts his card into the card reader 50, the user's card identification circuit 52 sends a signal to the discriminating circuit 37 and the circuit 37 again sends a signal to the second counter 55 so that the counting value "1" set in the counter 55 is reset to "zero". Consequently, the counter 55 sends a signal to the reset terminal R of the third flip-flop circuit 48. Thus, the above-mentioned output signal of the circuit 48 disappears at the output terminal thereof. This means that a signal input into one of the input terminals of the second AND gate 58 disappears. The other input terminal of the second AND gate 58 is connected to the second delay circuit 35, which generates a signal at its output terminal a predetermined delay time after the initial setting of the patrol mode in the apparatus 1. Therefore, it is understood that if the patrol mode is set while the apparatus 1 is in the manned security-ensuring operation mode, it is set by the patroller's card and the manned security-ensuring operation mode is restored by the user's card. If this operational principle is not followed, a signal appears at the output terminal of the second AND gate 58. As a result, the additional-patrolling signal-generating circuit 39 is operated, and an additional-patrolling signal is automatically transmitted to the central monitoring station 43 via the signal-transmitting circuit 42. At this stage, it should be understood that while the apparatus 1 is set in the manned security-ensuring operation mode, since the user stays in the predetermined protected area, the patrol engineers can borrow the user's card from the user in order to restore the current operation mode of the apparatus 1 to the manned security-ensuring operation mode.

From the foregoing description, it will be understood that in the security-ensuring apparatus 1 of the third embodiment of FIG. 3, the second and third AND gates 58 and 59 and the second delay circuit 35 are effectively used for monitoring the predetermined time period of the patrol mode. Therefore, the central monitoring station 43 is automatically informed of the additional patrolling of the patrol engineers. Thus, the safety of the patrol engineers can be guaranteed. In addition, it is possible for the monitor of the central monitoring station 43 to determine whether or not the patrol engineers execute a correct patrol operation, especially in a case where the patrol operation is carried out during the manned security-ensuring operation mode.

In the apparatus 1 of the third embodiment, due to the provision of the second counter 55 and the third flip-flop circuit 48, if the operation mode of the apparatus is switched from the manned security-ensuring operation mode to the patrol mode, the patrol mode cannot be directly switched to the unmanned security-ensuring operation mode at the termination thereof. That is, the manned security-ensuring operation mode temporarily intervenes between the patrol mode and the unmanned security-ensuring operation mode. As a result, incorrect operation of the apparatus 1 is effectively avoided. Thus, the combination of the above-mentioned second counter 55 and the third flip-flop circuit 48 may be technically referred to as an operation-mode-intervening unit which enables the temporary intervention of a given operation mode between two existing operation modes of the security-ensuring apparatus 1.

In the security-ensuring apparatus 1 of the third embodiment of FIG. 3, the maintenance mode is set by engaging the switch 15*c* with the contact 18. As soon as the switch 15*c* engages with the contact 18, a signal is input into the set terminal S of the first flip-flop circuit 46 so that an output signal appears at the output terminal Q of the circuit 46. The output signal of the circuit 46 is then input into one of the input terminals of the NAND gate 56, as well as one of the input terinals of the AND gate 57 and the first delay circuit 34. The other input terminal of the NAND gate 56 is connected to the emergency-detecting circuit 14 so as to receive an emergency or abnormality signal from the circuit 14. Therefore, during the maintenance mode, the NAND gate 56 prohibits transmission of an emergency or abnormality signal from the circuit 14 to the discriminating circuit 37. As a result, no emergency or abnormality signal is eventually transmitted to the central monitoring station 43. This is because, during the maintenance mode, the engineers or the user are able to take necessary action to bring an emergency or abnormality in the predetermined protected area under control. Further, if the emergency or abnormality is a test emergency or abnormality of the maintenance mode, it is evidently unnecessary to transmit a test emergency or abnormality signal to the central monitoring station 43.

Figure 4:
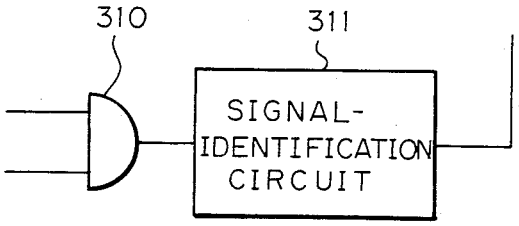
FIG. 4 is a circuit diagram of a modified part of the apparatus of FIG. 1 and of the apparatus of FIG. 2.

However, alternatively, the NAND gate 56 may be replaced with a combination of the AND gate 310 and the signal identification circuit 311 illustrated in FIG. 4. As a result, during the maintenance mode, an emergency or abnormality signal is given an appropriate identification code and is transmitted to the central monitoring station 43. Therefore, the central monitoring station 43 is able to discriminate that the transmitted emergency or abnormality signal indicates that an emergency or abnormality has occurred in the predetermined protected area during the maintenance mode of the apparatus 1. Consequently, the central monitoring station 43 does not dispatch engineers to the site of the emergency or abnormality during the maintenance mode of the apparatus 1. Accordingly, the cost of running the security-ensuring apparatus 1 can be reduced. Further, if the above-mentioned identification code includes information on the machine code and the user's code, the transmitted emergency or abnormality signal including the identification code can be effectively used for obtaining statistical data on the operation of the security-ensuring apparatus.

As was mentioned before, the output signal of the flip-flop circuit 46 is input into one end of the input terminal of the first AND gate 57 and into the input terminal of the first delay circuit 34, the output terminal of which is connected to the other input terminal of the AND gate 57. That is, the first delay circuit 34 sends a signal to the other input terminal of the AND gate 57 a predetermined delay time after the receipt of the output signal of the circuit 46. The predetermined delay time is one that is preliminarily set in the first delay circuit for determining the time of the maintenance mode. Therefore, if the switch 15 is disengaged from the contact 18 prior to the sending of the signal from the circuit 34 to the AND gate 57, no signal appears at the output terminal of the AND gate 57 to operate the additional-maintenance signal-generating circuit 38.

On the contrary, if the switch 15 is not disengaged from the contact 18 prior to the sending of the signal from the circuit 34 to the AND gate 57, a signal appears at the output terminal of the AND gate 57. Therefore, the additional-maintenance signal-generating circuit 38 sends an additional-maintenance signal to the central monitoring station 43 via the signal-transmitting circuit 42. Thus, the central monitoring station 43 is able to determine whether or not the maintenance operation by the engineers has been completed in the predetermined maintenance time. If necessary, an appropriate unit or device may be introduced into the apparatus 1 of FIG. 3 to discriminate between the maintenance operation conducted by the engineers and that conducted by the user per se.

From the foregoing description, it will be understood that, according to the security-ensuring apparatus of the third embodiment, the patrol mode and the maintenance mode are respectively effected as an operation mode of the security-ensuring apparatus and are monitored by the central monitoring station. Further, during the maintenance mode, a test emergency or abnormality signal is not transmitted to the central monitoring station 43. That is, such test emergency or abnormality signal is transformed into a particular identifiable signal and is then transmitted to the central monitoring station 43. Therefore, the central monitoring station 43 is able to definitely discriminate between an actual emergency or abnormality signal and the test emergency or abnormality signal. Consequently, the central monitoring station 43 is able to dispatch engineers to the site of the emergency or abnormality only in the case of an actual emergency or abnormality in the predetermined protected area. Accordingly, the reliability of an alarm system comprising the security-ensuring apparatus of the present invention, emergency sensors, and a central monitoring station can be high. In addition, the cost of running the alarm system can be kept low. Furthermore, it is possible to obtain accurate statistical data on the operation of the security-ensuring apparatus. Moreover, since the time period of the maintenance mode and the time period of the patrol mode are preliminarily set to an optimum one, respectively, and since they are automatically monitored by the central monitoring station, no problem occurs if the engineers forget to inform the central monitoring station of termination of the maintenance and patrol modes. Naturally, the safety of the engineers is always guaranteed.

It should be understood that in the first through third embodiments of the present invention, the display unit 41 may comprise alarm lamps, alarm buzzers, a loudspeaker system, a liquid crystal display, a cathode-ray tube display, or a combination thereof. Further, diverse kinds of emergency sensors, in addition to the described unauthorized-entry sensors 10 and fire sensors 12, such as gas-leakage sensors, equipment failure sensors, panic buttons, etc., may be connected to the emergency-detecting unit 13. Furthermore, the switches 15, 15*a*, 15*b*, and 15*c* may be any known type of switches.

I claim:

1. A security-ensuring apparatus for ensuring the security of a predetermined area in association with emergency sensors suitably arranged in the predetermined area and a central monitoring station located distant from the predetermined area, comprising:

means for selectively setting an operation mode of said security-ensuring apparatus in a security-ensuring operation mode including a manned security-ensuring operation mode, an unmanned security-ensuring operation mode, and a management operation mode including at least a maintenance mode or a patrol mode;

an emergency-detecting means connected to said emergency sensors for electrically detecting an emergency or abnormality sensed by said emergency sensors and generating a corresponding electric signal;

a controlling means for discriminating whether or not said electric signal indicating an emergency or abnormality should be transmitted to said central monitoring station on the basis of which operation mode of said security-ensuring and management operation modes is set in said security-ensuring apparatus; and a signal-transmitting means for transmitting said electric signal indicating an emergency or abnormality to said central monitoring station when said discriminating means discriminates that said electric signal should be transmitted to said central monitoring station.

2. A security-ensuring apparatus as claimed in claim 1, wherein said controlling means comprises:

a delay circuit unit for establishing a predetermined limited time period for which said management operation mode of said apparatus should continue;

monitoring means for determining whether or not said management operation mode has continued for a time period which exceeds said predetermined limited time period; and a signal-generating means for generating an additional-operation signal when it is determined by said monitoring means that said management operation mode has continued for said time period which exceeds said predetermined limited time period.

3. A security-ensuring apparatus as claimed in claim 2, wherein said delay circuit unit comprises a first delay circuit for establishing a first predetermined limited time period for which said maintenance mode of said management operation mode should continue and a second delay circuit for establishing a second predetermined limited time period for which said patrol mode of said management operation mode should continue.

4. A security-ensuring apparatus as claimed in claim 3, wherein said monitoring means comprises: a first logical circuit connected to said first delay circuit and generating a signal indicating that said maintenance mode has continued for a time period that exceeds said first predetermined limited time period; and a second logical circuit connected to said second delay circuit and generating a signal indicating that said patrol mode has continued for a time period that exceeds said second predetermined limited time period.

5. A security-ensuring apparatus as claimed in claim 4, wherein said signal-generating means comprises: an additional-maintenance signal-generating circuit having an input terminal connected to said first logical circuit and an output terminal connected to said signal-transmitting means; and an additional-patrolling signal-generating circuit having an input terminal connected to said second logical circuit and an output terminal connected to said signal-transmitting means.

6. A security-ensuring apparatus as claimed in claim 1, further comprising a display means connected to said controlling means for displaying at least said operation mode of said security-ensuring apparatus.

7. A security-ensuring apparatus as claimed in claim 1, wherein said means for selectively setting the operation mode comprises a combination of at least one switch and a plurality of electric contacts engageable with said switch.

8. A security-ensuring apparatus as claimed in claim 1, wherein said means for selectively setting the operation mode comprises a combination of a card reader and a card identification circuit means.

9. A security-ensuring apparatus as claimed in claim 1, wherein said controlling means comprises a NAND circuit means which prevents transmission of said electric signal indicating an emergency or abnormality from said emergency-detecting means to said signal-transmitting means while said maintenance mode of said management operation mode continues in said apparatus.

10. A security-ensuring apparatus as claimed in claim 1, wherein said controlling means comprises:

a memory means for storing an operation mode currently set in said apparatus;

a discriminating circuit means for discriminating, on the basis of said operation mode currently set in said apparatus, whether said security-ensuring operation mode or said management operation mode should be set by said means for selectively setting said operation mode; and a mode-intervening means for generating a temporary intervention mode between said currently set operation mode and a subsequently set operation mode.

* * * * *